US006510885B1

(12) United States Patent
Shih

(10) Patent No.: US 6,510,885 B1
(45) Date of Patent: Jan. 28, 2003

(54) VERTICAL BLINDS CURTAIN ATTACHMENT

(75) Inventor: Tsuiying Tsai Shih, Cerritos, CA (US)

(73) Assignee: Custom Craft Co., Cerritos, CA (US)

( * ) Notice: Subject to any disclaimer, the term of this patent is extended or adjusted under 35 U.S.C. 154(b) by 0 days.

(21) Appl. No.: 09/940,250

(22) Filed: Aug. 27, 2001

(51) Int. Cl.[7] ..... E06B 9/26
(52) U.S. Cl. ..... 160/89; 160/236; 160/900
(58) Field of Search ..... 160/89, 166.1 R, 160/84.01, 900, 168.1 R, 236, 168.1 V

(56) References Cited

U.S. PATENT DOCUMENTS 3,844,330 A 10/1974 Hyman
3,851,699 A 12/1974 Shapiro
5,012,552 A 5/1991 Wulf
5,392,833 A 2/1995 Ohanesian
5,638,880 A * 6/1997 Colson et al. ..... 160/84.01
5,638,881 A * 6/1997 Ruggles et al. ..... 160/89 X
5,713,407 A 2/1998 Judkins
5,715,883 A 2/1998 Keith
5,743,318 A * 4/1998 Ruggles et al. ..... 160/89 X
5,749,404 A 5/1998 Colson
6,186,213 B1 2/2001 Senesac
6,334,477 B1 * 1/2002 Moir ..... 160/89 X

* cited by examiner

*Primary Examiner*—David M. Purol
(74) *Attorney, Agent, or Firm*—Sheldon & Mak

(57) ABSTRACT

A curtain cover attachment for vertical blinds has flexible sheet material portions that fold over opposite sides of each vane of the blinds from a front edge thereof, the panel portions extending also between the vanes. The cover is supported by first tabs that fold over one end (the tops ) of the vanes opposite respective supportive stem portions thereof from the front edges, the tabs being secured by hook-loop fasteners that are hidden between the cover and the vanes. Additional tabs and associated fasteners can also be used between the stem portions and the front edges of the vanes, as well as at opposite ends of the vanes.

19 Claims, 3 Drawing Sheets

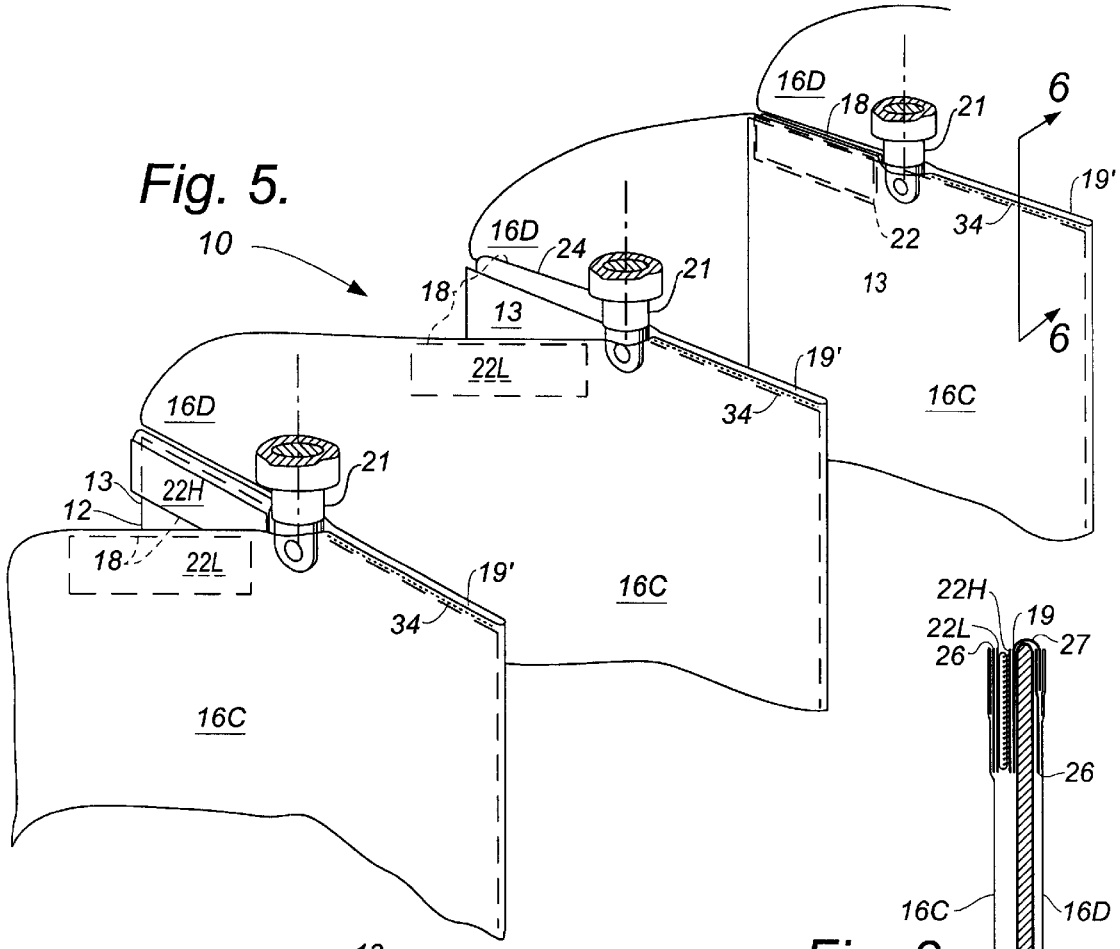
Fig. 5.
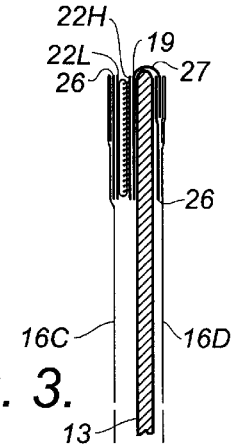
Fig. 3.
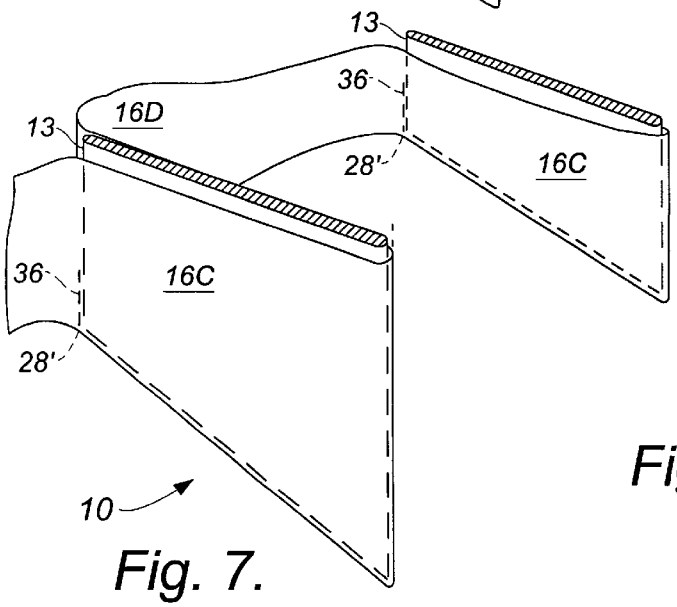
Fig. 7.
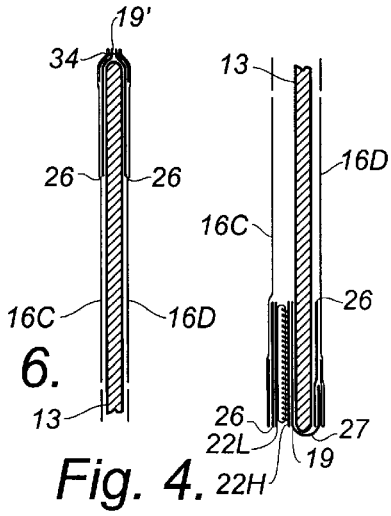
Fig. 6.
Fig. 4.

VERTICAL BLINDS CURTAIN ATTACHMENT

BACKGROUND

The present invention relates to enhancements for vertical blinds, an more particularly to a curtain attachment for such blinds.

Vertical window blinds are well known, and such blinds having fabric or other sheet material attached as a curtain are also known, being disclised, for example, in U.S. Pat. No. 3,844,330 to Hyman, U.S. Pat. No. 3,851,699 to Shapiro, U.S. Pat. No. 5,439,042 to Ohanesian, U.S. Pat. No. 5,638,881 to Ruggles et al., and U.S. Pat. No. 6,186,213 to Senesac. A principal disadvantage of the devices disclosed in each of these patents is that specific structure of the blinds is adapted for attachment of the curtain; consequently they do not provide a practical means for converting conventional vertical blinds not having such structure. Also, installation of the blind with the curtain assembled therewith unnecessarily exposes the curtain to soiling and/or damage. U.S. Pat. No. 5,715,883 to Keith discloses a similar combination wherein the curtain is formed with pockets for receiving upper extremities of respective vanes, the vanes being inserted into the pockets prior to assembly into a support mechanism of the blinds. This arrangement also is not entirely satisfactory in that the assembly operation is cumbersome, and extra labor of disassembly is required when the curtain is to be installed on previously assembled blinds. Further, the extra handling of the curtain that is needed during assembly of the vanes is likely to result in objectionable soiling of the curtain.

Thus there is a need for a curtain attachment for vertical blinds that avoids the disadvantages of the prior art.

SUMMARY

The present invention meets this need by providing a curtain attachment that does not rely on specially adapted supporting structure of the blinds, and which can be attached to the parallel-spaced vanes of assembled blinds without modification thereof. In one aspect of the invention, the curtain attachment includes a vane cover having at least four longitudinal panel portions, an interior adjacent plurality of the panel portions having a main panel width being not less than a vane width of the blinds plus half of a stem spacing between the vanes; and first fastener means for removably connecting each of the panel portions to an adjacent one of the panel portions with the adjacent panel portions folded over opposite sides of a corresponding vane along a front edge thereof, the first fastener means being spaced opposite stem member of the vane from the front edge for retaining the vane cover proximate the front edge of the vane member. The first fastener means can include a hook-loop fastener. The curtain attachment can also include respective laterally spaced first tab members connected to and projecting from alternate ones of the panel portions with the first fastener means removably connecting each of the second tab members to a corresponding adjacent panel portion. The first tab member can be folded over respective end edges of the vanes, projecting between the vanes and the adjacent panel members, the first fastener means being covered by the vane cover.

The curtain attachment can also include second fastener means for connecting the adjacent panel portions between the stem member and the front edge of the corresponding vanes. The second fastener means can also include a hook-loop fastener, and/or respective laterally spaced second tab members connected to and projecting from alternate ones of the panel portions in laterally spaced relation to the first fastener means, the second fastener means preferably removably connecting each of the second tab members to a corresponding adjacent panel portion to permit an unfolded condition of the vane cover. Further, the second tab members can be folded over the end edge of the vane with the second fastener means being covered by the vane cover. Alternatively, the second fastener means can include respective seams connecting facing adjacent panel portions.

The curtain attachment can also include third fastener means for connecting the adjacent panel portions opposite the stem members of the vanes. The third fastener means can include a hook-loop fastener and/or respective laterally spaced third tab members connected to and projecting from alternate ones of the panel portions opposite the first tab members, the third fastener means removably connecting each of the third tab members to a corresponding adjacent panel portion. The third tab members can also be folded over an opposite end edge of each vane, projecting between the vane and the adjacent panel members, the third fastener means being covered by the vane cover.

In another aspect of the invention, the curtain attachment includes a rectangular vane cover having at least four laterally contiguous longitudinal panel portions; respective laterally spaced first tab members connected to and projecting from alternate ones of the panel portions proximate respective ends thereof; a first plurality of hook-loop fasteners for removably connecting each of the first tab members to a corresponding adjacent panel portion, one hook-loop element being affixed to each of the first tab members, a mating hook-loop element being affixed to the adjacent panel portion and oriented for effecting the connection with the vane cover being folded between the adjacent panel portions and with the first tab portions folded over, the first fastener means being spaced from the fold between the adjacent panel portions; respective laterally spaced second tab members connected to and projecting from alternate ones of the panel portions in laterally spaced relation to the first tab members; a second plurality of hook-loop fasteners for removably connecting each of the second tab members to a corresponding adjacent panel portion, one hook-loop element being affixed to the second tab members, a mating hook-loop element being affixed to the adjacent panel portion and oriented for effecting the connection with the second tab portions folded over, the second tab members being located between corresponding ones of the first tab members and corresponding folds between the adjacent panel portions, and spaced from the first tab members; respective laterally spaced third tab members connected to and projecting from alternate ones of the panel portions opposite the first and second tab members; and a third plurality of hook-loop fasteners for removably connecting each of the third tab members to a corresponding adjacent panel portion with the third tab members folded over, the first, second, and third tab members projecting between the corresponding adjacent panel portions, the hook-loop fasteners being covered by the vane cover. A first reinforcing tape can be connected to the vane cover along the ends of the panel portions, the first and second tab members and one element of each of the first and second hook-loop fasteners being affixed to the first reinforcing tape. A second reinforcing tape can also be connected to the vane cover along opposite ends of the panel portions, the third tab members and one element of each of the third hook-loop fasteners being affixed to the second reinforcing tape.

DRAWINGS

These and other features, aspects, and advantages of the present invention will become better understood with reference to the following description, appended claims, and accompanying drawings, where:

FIG. 3 is a lateral sectional view on line 3—3 of FIG. 1;

FIG. 4 is a lateral sectional view on line 4—4 of FIG. 1;

FIG. 5 is a perspective view showing an alternative configuration of an upper portion of the curtain attachment of FIG. 1;

FIG. 6 is a sectional view on line 6—6 of FIG. 5; and

FIG. 7 is a perspective view showing an native configuration of a lower portion of the curtain attachment of FIG. 1.

DESCRIPTION

Figure 1:
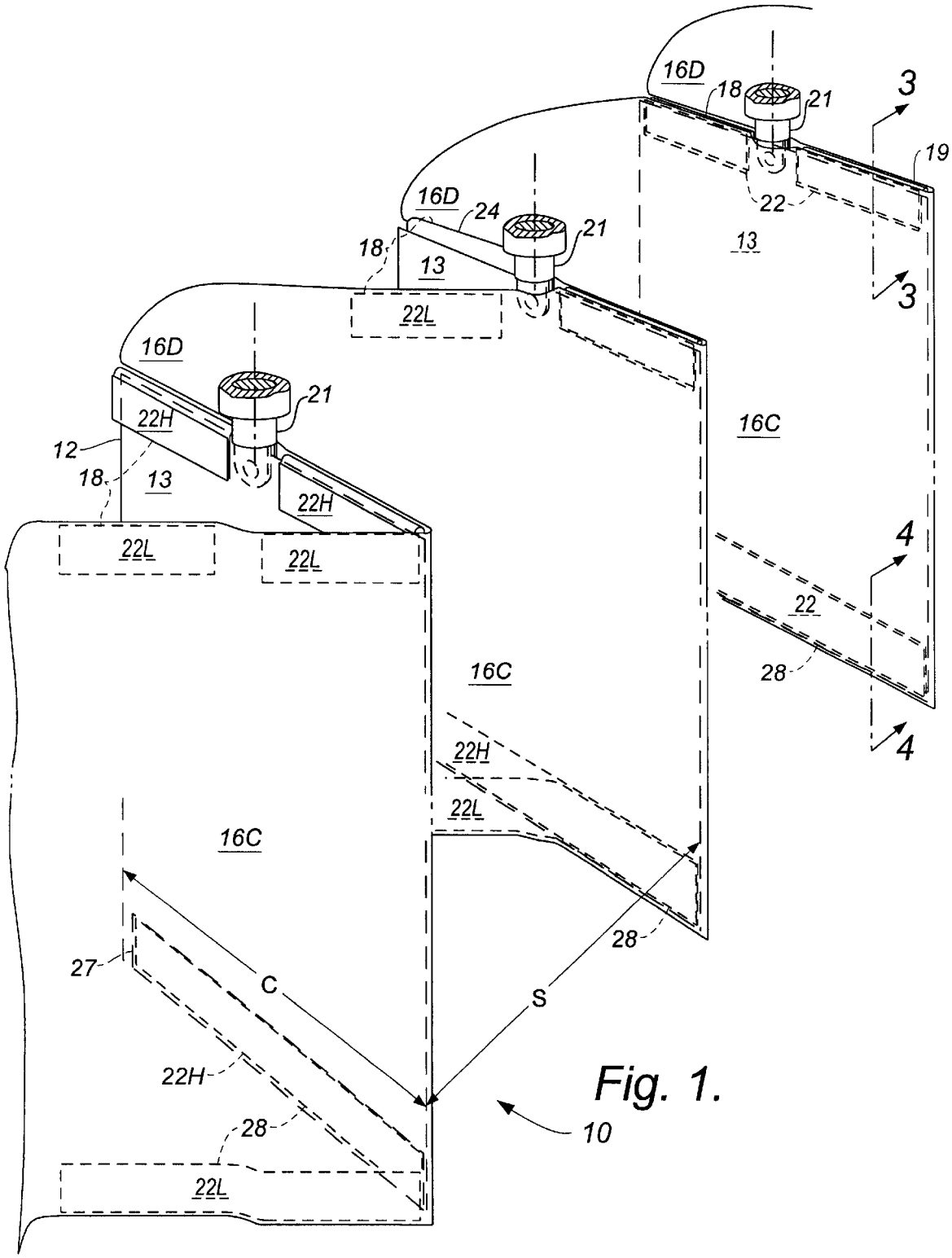
FIG. 1 is a fragmentary perspective view of a vertical blinds unit having a curtain attachment according to the present invention, showing stages in attachment of the curtain.

The present invention is directed to a vertical blinds curtain attachment that is particulary adapted for assembly onto a previously assembled blinds unit having a plurality of pivotable, vertically oriented vanes 13. With reference to FIGS. 1–4 of the drawings, a curtain attachment 10 for a vertical blinds unit 12 includes a blind vane cover 14 of flexible material, the cover 14 including a plurality of foldable panel portions 16, adjacent pairs of the panel portions being folded over opposite sides of the vanes along respective front edges 17 thereof, the cover 14 having respective spaced apart first and second fastener means 18 and 19 proximate an upper edge margin 20 thereof for suspending the cover 14 from upper extremities of the vanes 13 with respective stem portions 21 of the vanes projecting upwardly between the fastener means 18 and 19. The stem portions 21 are conventionally pivotally supported in a mechanism (not shown) of the blinds unit 12. In the exemplary configuration of FIGS. 1–4, the fastener means 18 and 19 each include a hook-loop fastener 22 and a tab member 24, the fastener 22 having separable hook and loop elements 22H and 22L. More particularly, the hook elements 22H are affixed to respective ones of the tab members 24, the loop elements being affixed to fabric reinforcing tape 26 that is in turn affixed proximate the upper edge margin 20 of the cover 14.

Figure 2:
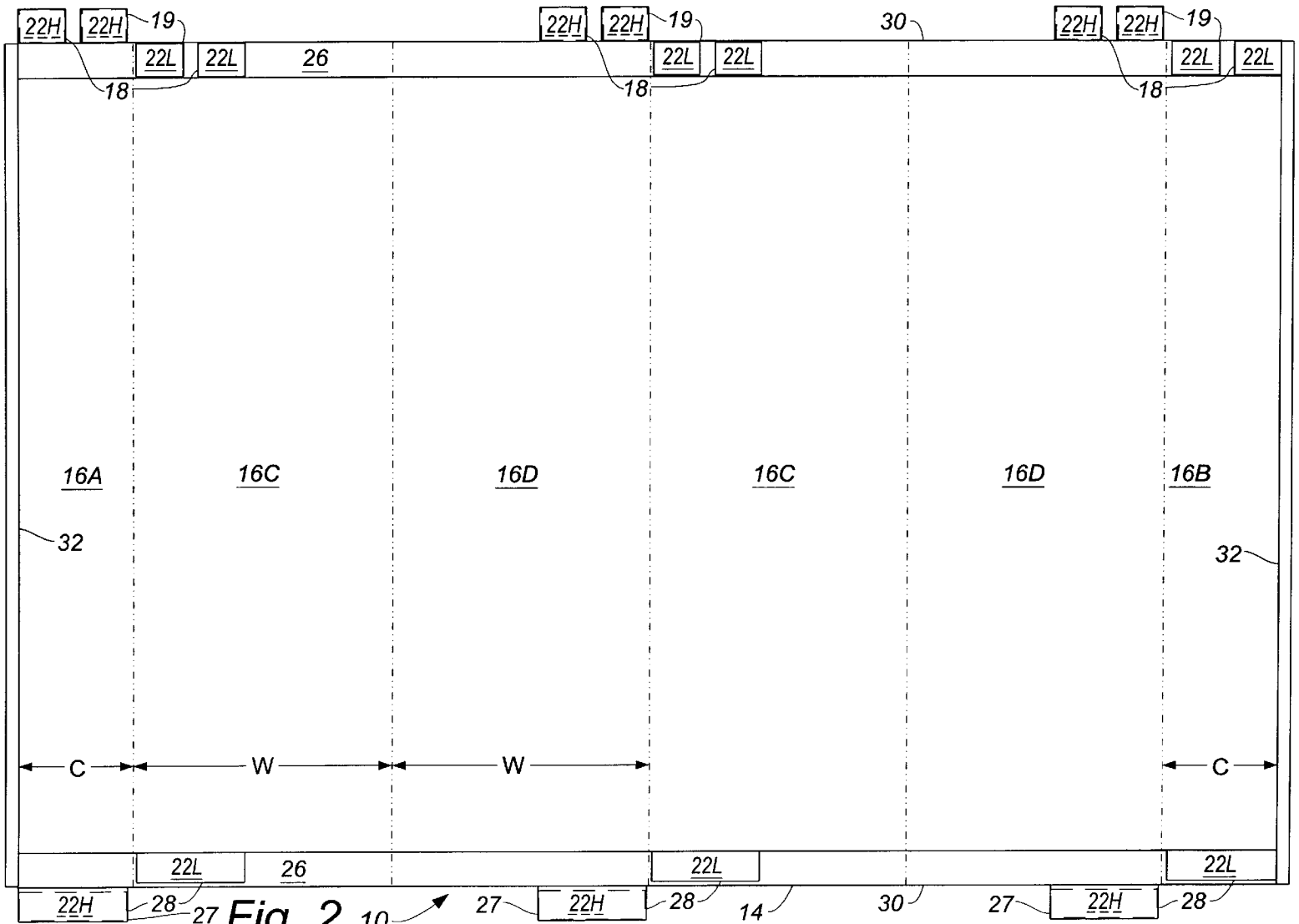
FIG. 2 is a pattern view of the curtain attachment of FIG. 1.

As best shown in FIG. 2, the hook elements 22H are affixed to the opposite side of the tab members 24 from the loop elements 22L and the reinforcing tape 26 in a flattened, unfolded condition of the cover 14. It will be understood that the locations of the hook and loop elements 22H and 22L can be exchanged. Also, the panel portions 16 include respective end panel portions 16A and 16B, and at least one pair of main panel portions 16C and 16D, one of the main panel portions 16C being adjacent the end panel portion 16A, and one of the main panel portions 16D being adjacent the end panel portion 16B, the others of the main panel portions, if present, being arranged in alternating sequence between those described above. The end panel portions 16A and 16B are of sufficient width to cover one side of respective vanes 13 as indicated by a chord dimension C in FIGS. 1 and 2, and the main panel portions 16C and 16D are of sufficient extra width to additionally span at least a spacing S (FIG. 1) between adjacent vanes 13 as indicated by the dimension W in FIG. 2, W being not less than C+S. Broken lines in FIG. 2 represent fold lines between the panel portions, such as for a storage condition of the cover 14, the cover 14 being folded at least alternate ones of the fold lines in the installed condition thereof. It will be understood that additional folding of the vane cover 14 in the installed condition is optional.

As further shown in FIGS. 1 and 2, a counterpart of the reinforcing tape 26 is optionally affixed with tab members 27 and third fastener means 28 proximate a lower edge margin 30 of the vane cover 14 for securing the cover 14 on lower extremities of the vanes 13. The third fastener means includes laterally extended counterparts of the hook-loop fasteners 22, the tab members 27 being correspondingly laterally extended. It will be understood that the configuration of the first and second fastener means 18 and 19 can alternatively be used at the lower edge margin 30 when the vertical blinds unit 12 has counterparts of the stem portions 21 at both ends of the vanes 13. In the exemplary configuration of FIGS. 1–4, hook elements 22H of the third fastener means 28 are affixed to the opposite side of the tab members 27 from the loop elements 22L and the reinforcing tape 26, both lengths of the tape 26 being affixed to the same side of the cover 24. Thus the hook-loop fasteners 22 of the first, second, and third fastener means 18, 19, and 28, are engageable with the tab members 24 and 27 folded over and the vane cover being folded in one direction between adjacent pairs of the panel portions 16 (and folded in an opposite direction, as for storage) between overlapping adjacent pairs). Also, opposite side edges of the vane cover 14 are hemmed adjacent outward extremities of the end panel portions 16A and 16B as indicated at 32, it being understood that the side hems 32 can be included portions of the end panel portions 16A and 16B. Further, suitable wall attachments can be affixed to the side hems 32, and the panel portions 16A and 16D can be extended in width as desired beyond the dimension C to facilitate connecting such wall attachments. Moreover, the number of the panel portions 16 normally corresponds to double the number of vanes 13 of the vertical blinds unit 12.

As best shown in FIGS. 3 and 4, the hook and loop elements 22H and 22L of the fasteners 22 come into facing engagable relationship when the respective tab members 24 and 27 are folded over opposite ends of the vanes 13.

With further reference to FIGS. 5 and 6, a counterpart of the second fastener means, designated 19', is formed by a seam 34 that joins adjacent ones of the panel portions 16 between a front edge of each vane 13 and the stem portion 21 thereof. This alternative affords reduced fabrication costs, but does not allow the vane cover to be opened up into the flat condition of FIG. 2.

With further reference to FIG. 7, a counterpart of the third fastener means, designated 28', is formed by a seam 36 that joins adjacent ones of the panel portions 16 behind a rear edge of each vane 13 proximate the bottom extremity of the vane cover 14. In this configuration, bottom extremities of respective vanes 13 are inserted into corresponding passages created by the seams 36 prior to fitting the first and second fastener means 18 and 19 (or 19').

Although the present invention has been described in considerable detail with reference to certain preferred versions thereof, other versions are possible. For example, the vane cover 14 can extend somewhat above the tops of the vanes 13, the attachment of the tabs 24 being correspondingly lowered. Similarly, the bottom of the cover can extend below the bottom of the vanes 13, or the bottom of the cover can be elevated above the bottoms of the vanes, particularly where the third fastener means 28 is not included. Further, the second fastener means 19 is not necessarily required, and the vane cover 14 need not be rectangular, particularly when it is desired to leave portions of at least some of the vanes exposed to view. Therefore, the spirit and scope of the appended claims should not necessarily be limited to the description of the preferred versions contained herein.

What is claimed is:

1. A curtain attachment for a blinds unit having parallel-spaced vanes, each vane having a vane length and a vane width, and a stem member axially projecting therefrom for pivotably supporting the vane, the curtain attachment comprising:

(a) a vane cover having at least four longitudinal panel portions, an interior adjacent plurality of the panel portions having a main panel width being not less than the vane width plus half of a stem spacing between the vanes; and (b) first fastener means for removably connecting each of the panel portions to an adjacent one of the panel portions with the adjacent panel portions folded over opposite sides of a corresponding vane along a front edge thereof, the first fastener means being spaced opposite the stem member from the front edge for retaining the vane cover proximate the front edge of the vane member and not requiring an opening to be formed in the vane.

2. The curtain attachment of claim 1, wherein the first fastener means comprises a hook-loop fastener.

3. A curtain attachment for a blinds unit having parallel-spaced vanes, each vane having a vane length and a vane width, and a stem member axially projecting therefrom for pivotably supporting the vane, the curtain attachment comprising:

(a) a vane cover having at least four longitudinal panel portions;

(b) first fastener means for removably connecting each of the panel portions to an adjacent one of the panel portions with the adjacent panel portions folded over opposite sides of a corresponding vane along a front edge thereof, the first fastener means being spaced opposite the stem member from the front edge for retaining the vane cover proximate the front edge of the vane member; and (c) respective laterally spaced first tab members connected to and projecting from alternate ones of the panel portions, the first fastener means removably connecting each of the second tab members to a corresponding adjacent panel portion.

4. The curtain attachment of claim 3, wherein the first fastener means comprises a hook-loop fastener.

5. The curtain attachment of claim 3, wherein the first tab member is folded over an end edge of the vane, projecting between the vane and the adjacent panel members, the first fastener means being covered by the vane cover.

6. The curtain attachment of claim 1, further comprising second fastener means for connecting the adjacent panel portions between the stem member and the front edge of the corresponding vanes.

7. The curtain attachment of claim 6, wherein the second fastener means comprises a hook-loop fastener.

8. A curtain attachment for a blinds unit having parallel-spaced vanes, each vane having a vane length and a vane width, and a stem member axially projecting therefrom for pivotably supporting the vane, the curtain attachment comprising:

(a) a vane cover having at least four longitudinal panel portions;

(b) first fastener means for removably connecting each of the panel portions to an adjacent one of the panel portions with the adjacent panel portions folded over opposite sides of a corresponding vane along a front edge thereof, the first fastener means being spaced opposite the stem member from the front edge for retaining the vane cover proximate the front edge of the vane member;

(c) second fastener means for connecting the adjacent panel portions between the stem member and the front edge of the corresponding vanes; and (d) respective laterally spaced second tab members connected to and projecting from alternate ones of the panel portions in laterally spaced relation to the first fastener means, the second fastener means removably connecting each of the second tab members to a corresponding adjacent panel portion.

9. The curtain attachment of claim 8, wherein the second fastener means comprises a hook-loop fastener.

10. The curtain attachment of claim 8, wherein the second tab member is folded over an end edge of the vane, projecting between the vane and the adjacent panel members, the second fastener means being covered by the vane cover.

11. The curtain attachment of claim 1, further comprising third fastener means for connecting the adjacent panel portions opposite the stem members of the vanes.

12. The curtain attachment of claim 11, wherein the third fastener means comprises a hook-loop fastener.

13. A curtain attachment for a blinds unit having parallel-spaced vanes, each vane having a vane length and a vane width, and a stem member axially projecting therefrom for pivotably supporting the vane, the curtain attachment comprising:

(a) a vane cover having at least four longitudinal panel portions;

(b) first fastener means for removably connecting each of the panel portions to an adjacent one of the panel portions with the adjacent panel portions folded over opposite sides of a corresponding vane along a front edge thereof, the first fastener means being spaced opposite the stem member from the front edge for retaining the vane cover proximate the front edge of the vane member;

(c) third fastener means for connecting the adjacent panel portions opposite the stem members of the vanes; and (d) respective laterally spaced third tab members connected to and projecting from alternate ones of the panel portions opposite the first tab members, the third fastener means removably connecting each of the third tab members to a corresponding adjacent panel portion.

14. The curtain attachment of claim 13, wherein the third fastener means comprises a hook-loop fastener.

15. The curtain attachment of claim 13, wherein the third tab member is folded over an end edge of the vane, projecting between the vane and the adjacent panel members, the third fastener means being covered by the vane cover.

16. A curtain attachment comprising:

(a) a rectangular vane cover having at least four laterally contiguous longitudinal panel portions;

(b) respective laterally spaced first tab members connected to and projecting from alternate ones of the panel portions proximate respective ends thereof;

(c) a first plurality of hook-loop fasteners for removably connecting each of the first tab members to a corresponding adjacent panel portion, one hook-loop element being affixed to each of the first tab members, a mating hook-loop element being affixed to the adjacent panel portion and oriented for effecting the connection with the vane cover being folded between the adjacent panel portions and with the first tab portions folded over, the first fastener means being spaced from the fold between the adjacent panel portions;

(d) respective laterally spaced second tab members connected to and projecting from alternate ones of the panel portions in laterally spaced relation to the first tab members;

(e) a second plurality of hook-loop fasteners for removably connecting each of the second tab members to a corresponding adjacent panel portion, one hook-loop element being affixed to the second tab members, a mating hook-loop element being affixed to the adjacent panel portion and oriented for effecting the connection with the second tab portions folded over, the second tab members being located between corresponding ones of the first tab members and corresponding folds between the adjacent panel portions, and spaced from the first tab members;

(f) respective laterally spaced third tab members connected to and projecting from alternate ones of the panel portions opposite the first and second tab members; and (g) a third plurality of hook-loop fasteners for removably connecting each of the third tab members to a corresponding adjacent panel portion with the third tab members folded over, (h) the first, second, and third tab members projecting between the corresponding adjacent panel portions, the hook-loop fasteners being covered by the vane cover.

17. The curtain attachment of claim 16, further comprising a first reinforcing tape connected to the vane cover along the ends of the panel portions, the first and second tab members and one element of each of the first and second hook-loop fasteners being affixed to the first reinforcing tape.

18. The curtain attachment of claim 17, further comprising a second reinforcing tape connected to the vane cover along opposite ends of the panel portions, the third tab members and one element of each of the third hook-loop fasteners being affixed to the second reinforcing tape.

19. A curtain attachment for a blinds unit having parallel-spaced vanes, each vane having a vane length and a vane width, and a stem member axially projecting therefrom for pivotably supporting the vane, the curtain attachment comprising:

(a) a vane cover having at least four laterally contiguous longitudinal panel portions, the panel portions having a length being approximately equal to the vane length, an interior adjacent plurality of the panel portions having a main panel width being not less than the vane width plus half of a stem spacing between the vanes;

(b) respective laterally spaced first tab members connected to and projecting from alternate ones of the panel portions;

(c) a first plurality of hook-loop fasteners for removably connecting each of the first tab members to a corresponding adjacent panel portion with the first tab portions folded over opposite sides of a corresponding vane along an end edge thereof and with the adjacent panel portions folded over opposite sides of a corresponding vane along a front edge thereof, the first fastener means being spaced opposite the stem member from the front edge for retaining the vane cover proximate the front edge of the vane member (d) respective laterally spaced second tab members connected to and projecting from alternate ones of the panel portions in laterally spaced relation to the first tab members;

(e) a second plurality of hook-loop fasteners for removably connecting each of the second tab members to a corresponding adjacent panel portion with the second tab of the vane;

(f) respective laterally spaced third tab members connected to and projecting from alternate ones of the panel portions opposite the first and second tab members; and (g) a third plurality of hook-loop fasteners for removably connecting each of the third tab members to a corresponding adajacent panel portion with the third tab members folded over an opposite end edge of the vane, (h) the first, second, and third tab members projecting between the vane cover, the hook-loop fasteners being covered by the vane cover.

* * * * *